US005257859A

United States Patent [19]

Wong

[11] Patent Number: 5,257,859

[45] Date of Patent: Nov. 2, 1993

[54] DRAWER FOR CATALOGUE CARD

[75] Inventor: Tsung-An Wong, Taipei, Taiwan

[73] Assignee: Kewa Office & Library Products Co., Ltd., Taipei, Taiwan

[21] Appl. No.: 792,163

[22] Filed: Nov. 14, 1991

[51] Int. Cl.[5] ..... B42F 17/02

[52] U.S. Cl. ..... 312/190; 312/348.5; 220/535; 402/61

[58] Field of Search ..... 312/183, 190, 191, 348.3, 312/348.5; 40/392, 401, 404; 211/57.1; 220/529, 535, 538; 402/60, 62, 502

[56] References Cited

U.S. PATENT DOCUMENTS 3,370,591 2/1968 Coe ..... 402/502 X
3,405,716 10/1968 Cafiero et al. ..... 402/502 X
3,495,731 2/1970 Risum et al. ..... 402/502 X
3,556,621 1/1971 Blakley ..... 312/183 X
3,841,767 10/1974 Little ..... 402/502 X

FOREIGN PATENT DOCUMENTS 393881 9/1908 France ..... 402/61

*Primary Examiner*—Kenneth J. Dorner
*Assistant Examiner*—Brian K. Green
*Attorney, Agent, or Firm*—Rodman & Rodman

[57] ABSTRACT

An apparatus for keeping a stack of catalogue cards in neat order to be used, for example, in a library. If necessary, a librarian can replace a damaged catalogue card with a new one by just pressing a button at the bottom of the drawer to enable a compression spring to eject the metal rod passing through a stack of catalogue cards. Consequently, the librarian can freely rearrange the catalogue cards.

2 Claims, 5 Drawing Sheets

DRAWER FOR CATALOGUE CARD

BACKGROUND OF THE INVENTION

The present invention relates to a means for keeping catalogue cards in a drawer, which can be used, for example, in a library, a company, etc.

In the past, the drawers, containing the catalogue cards kept in place with a metal rod inserted through the front face of the drawer catalogue cards, have been made of metal or wood. Since the metal used for manufacturing said drawer is too heavy to move and more expensive to sell at a competitive price, and a wooden drawer eventually suffers from falling apart, the inventor has devised a method to make it at a lower cost.

Furthermore, the inventor has utilized modern manufacturing technology such as mold injection to form a light drawer, which is easier to disassemble.

SUMMARY OF THE INVENTION

In view of the inconvenience of disassembling the conventional drawer, the inventor has conceived a smart mechanism to facilitate removing or discarding the catalogue cards by easily removing the metal rod passing through the hole located at the bottom of catalogue cards. The present invention allows a librarian to replace or discard the old catalogue cards, and insert new catalogue cards more easily than the conventional drawer.

It is accordingly an object of the present invention to provide a method for conveniently removing the metal rod from the drawer in order to rearrange the catalogue cards, insert new ones, and discard the broken ones. The most important feature of the present invention lies in the rod clamping-and-releasing device, which can clamp a rod passing through a stack of catalogue cards and, if necessary, eject the rod by a compression spring.

Another object of the present invention is to offer a cheaper way to manufacture the drawer. One feature of the present invention is that the drawer is made of light material. In the present invention, the inventor mainly uses plastic material to form the receptacle of the drawer. The remaining parts of the drawer consist of a rod made of stainless steel, a rod-clamping-and-releasing device made of brass, and a movable back-up plate.

BRIEF DESCRIPTION OF THE DRAWINGS

The above and other objects, features and advantages of the present invention will become more apparent from reading the following description of the preferred embodiments, taken in connection with the accompanying drawings in which.

DETAILED DESCRIPTION OF THE EMBODIMENT

Figure 1:
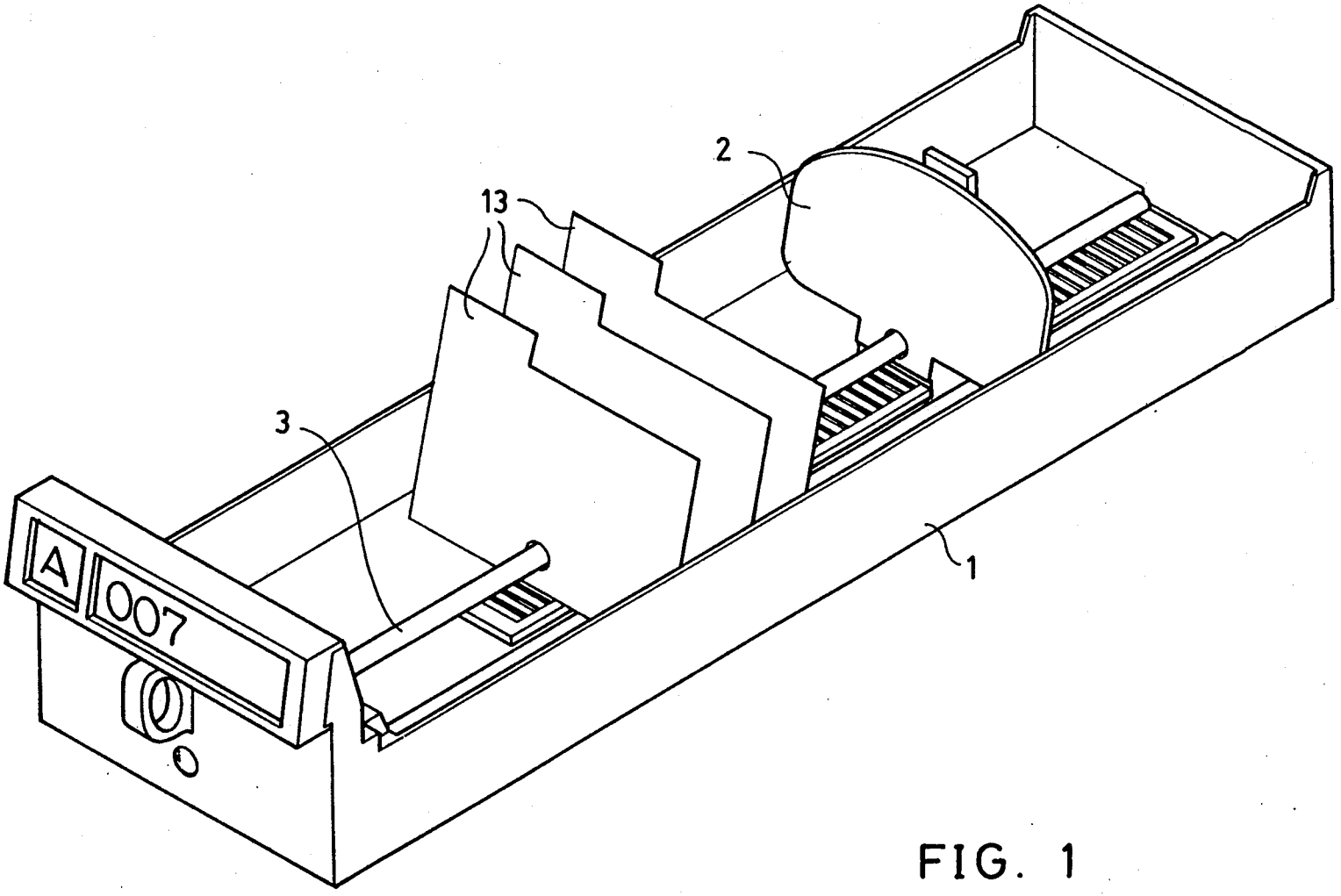
FIG. 1 is a perspective view of a drawer.
Figure 2:
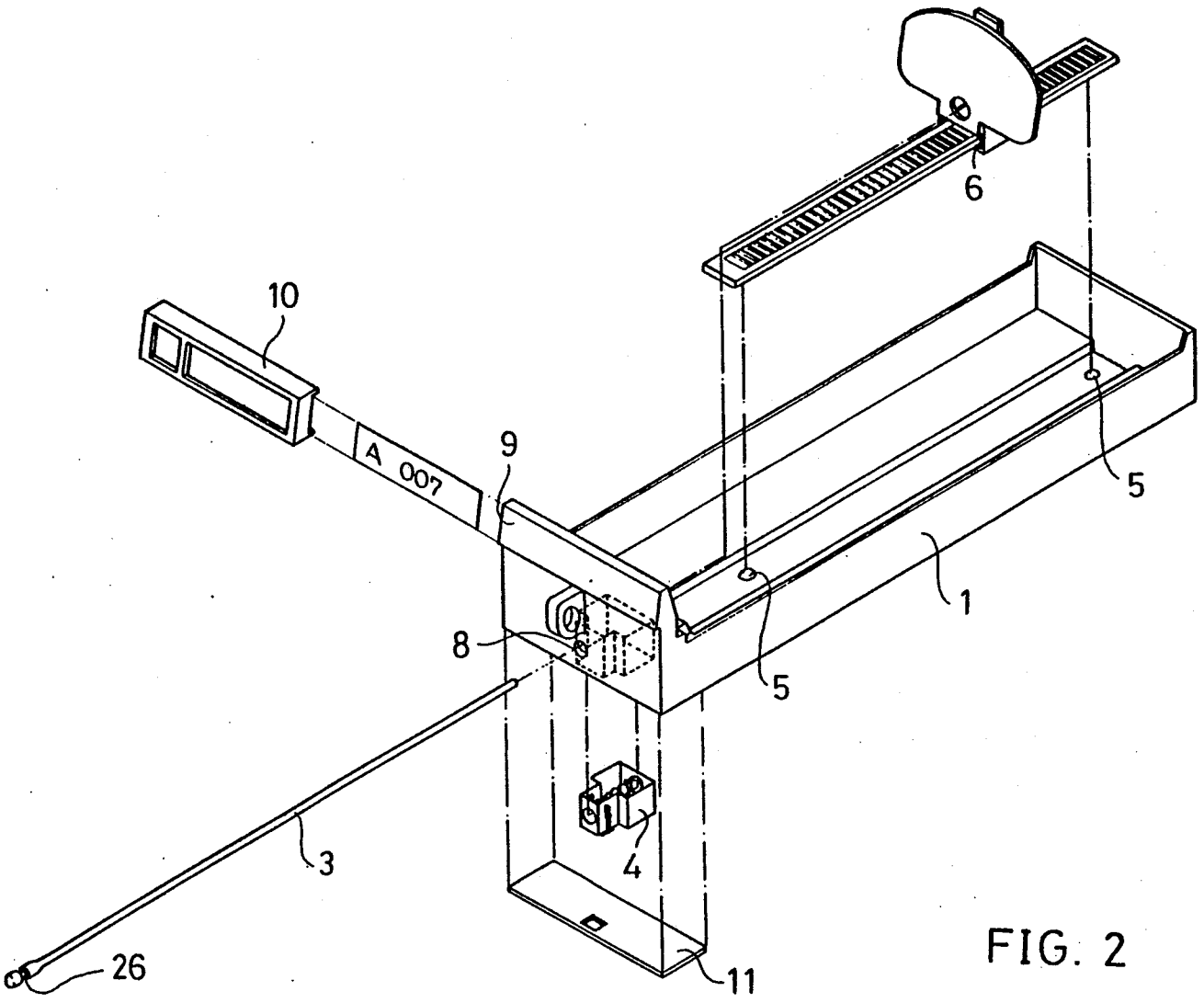
FIG. 2 is an exploded view of the drawer shown in FIG. 1.
Figure 3:
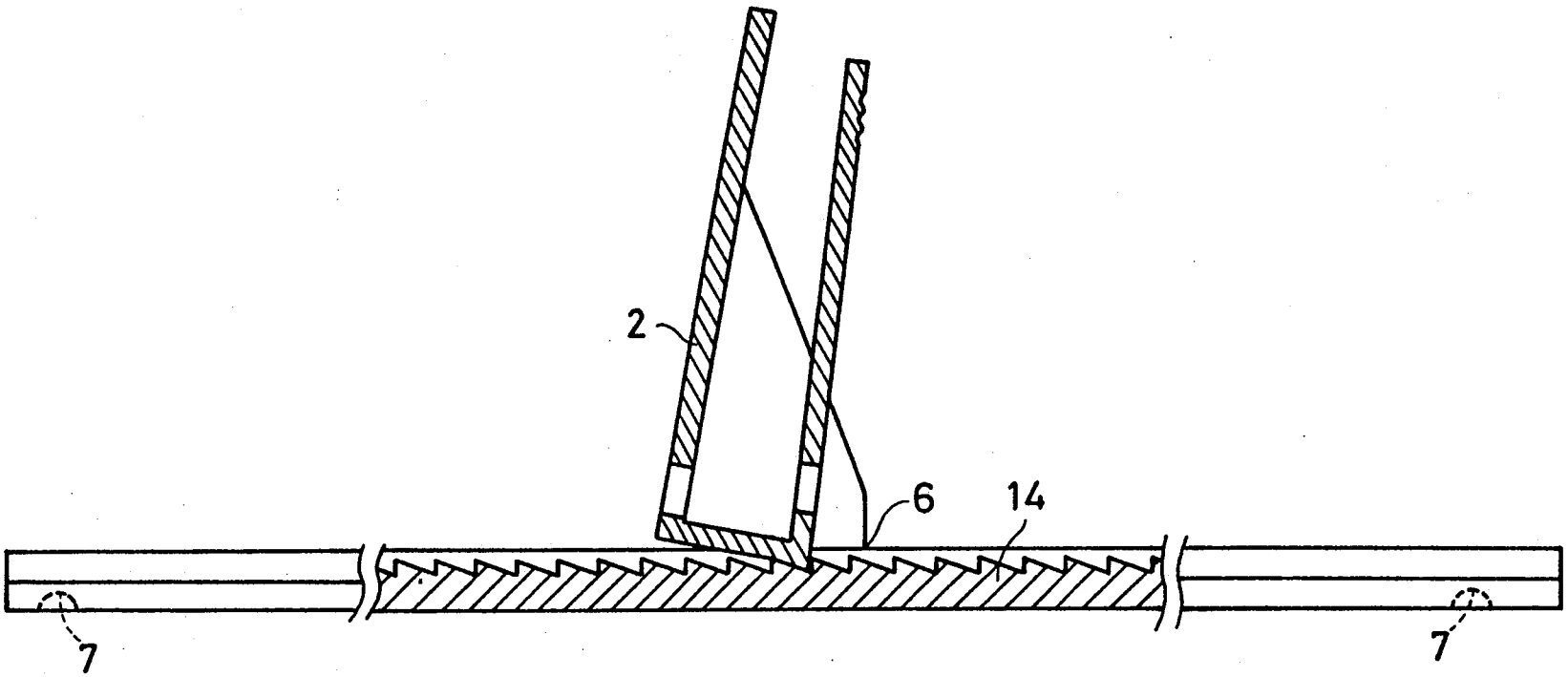
FIG. 3 is a partial cross-sectional view taken from FIG. 1 illustrating how the back-up plate works.
Figure 4:
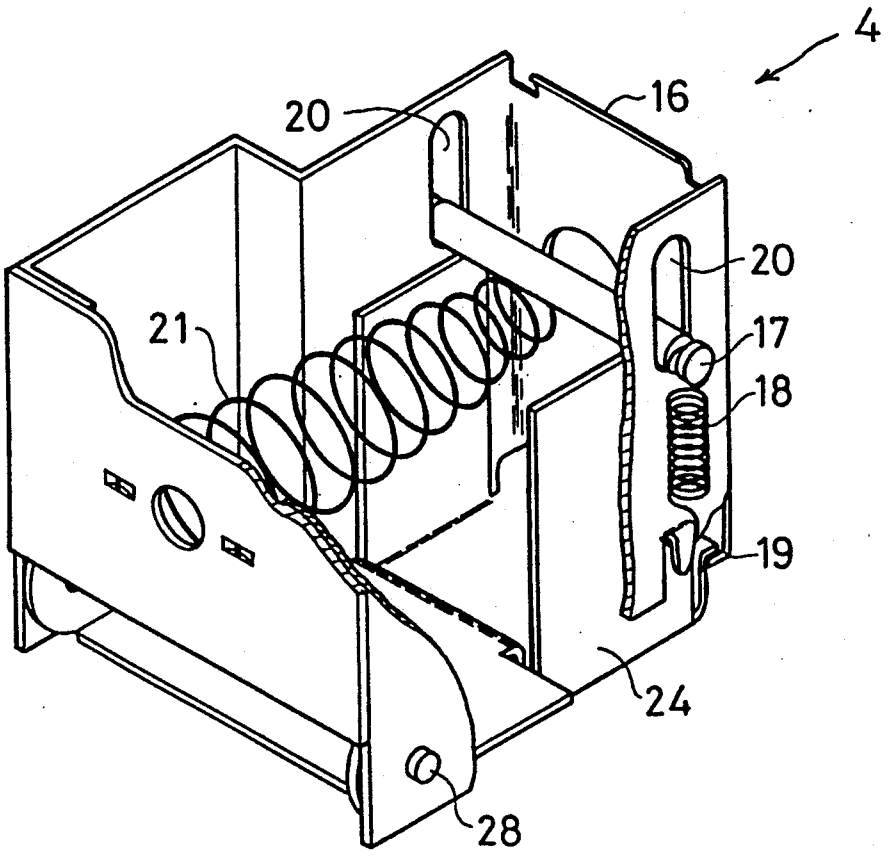
FIG. 4 is a perspective view of the rod clamping-and-releasing device.

FIG. 1 shows the overall construction of a drawer which consists of four main parts, namely, receptacle 1, back-up plate 2, metal rod 3, and rod clamping-and-releasing device 4 as shown in FIG. 4. With reference to FIG. 2 and FIG. 3, said receptacle 1 is provided with two rounded protrusions 5, which are integrally formed with said receptacle 1. A back-up assembly 6, with two rounded recesses 7 provided at the bottom of said back-up assembly 6, will loosely rest on said receptacle 1. Owing to said two rounded protrusions 5 on said back-up assembly 6, said back-up assembly 6 rests on said receptacle 1 without any relative movement to each other. On the front end face of said receptacle 1, there is provided a hole 8 to accommodate a metal rod 3 to go through. An advantage of the present invention lies in the design of a label seat 9 integrally formed with said receptacle 1 at an oblique angle for a good viewing. Furthermore, a label cover 10 can be fitted into said label seat 9 and then fixed thereon with the aid of an adhesive substance. Said label cover 10 is molded such that there is a clearance established between said label seat 9 and said label cover 10 for the label to be inserted. There are still two windows provided on said label cover 10 in order to show a library user the details on a label.

With reference to FIG. 1 and FIG. 2, said metal rod 3 is used to keep the catalogue cards 13 in neat order. Said catalogue cards 13 which have holes thereon can slidably move back and forth on said metal rod 3.

Referring now to FIG. 3, the back-up assembly 6 comprises a toothed rack 14, and slidable back-up plate 2. Said toothed rack 14, provided with two rounded recesses 7 on the bottom of said toothed rack 14 having the same distance between said two rounded recesses 7 as that between two rounded protrusions 5 of the receptacle 1, is designed to provide a guide rack to slidable back-up plate 2 to stop at any position on said toothed rack 14. Said toothed rack 14 fitted into said slidable back-up plate 2 which is provided with a flexible back-up plate 15 made of plastic and formed integrally with said slidable back-up plate 2 which can be bent a little in the direction shown in the FIG. 3 so that the lower end of said flexible back-up plate will be raised up a tiny amount of distance from its normal position such that said movable back-up plate 2 can settle on said toothed rack 14, at any place in accordance with the quantity of said catalogue cards 13.

Figure 5:
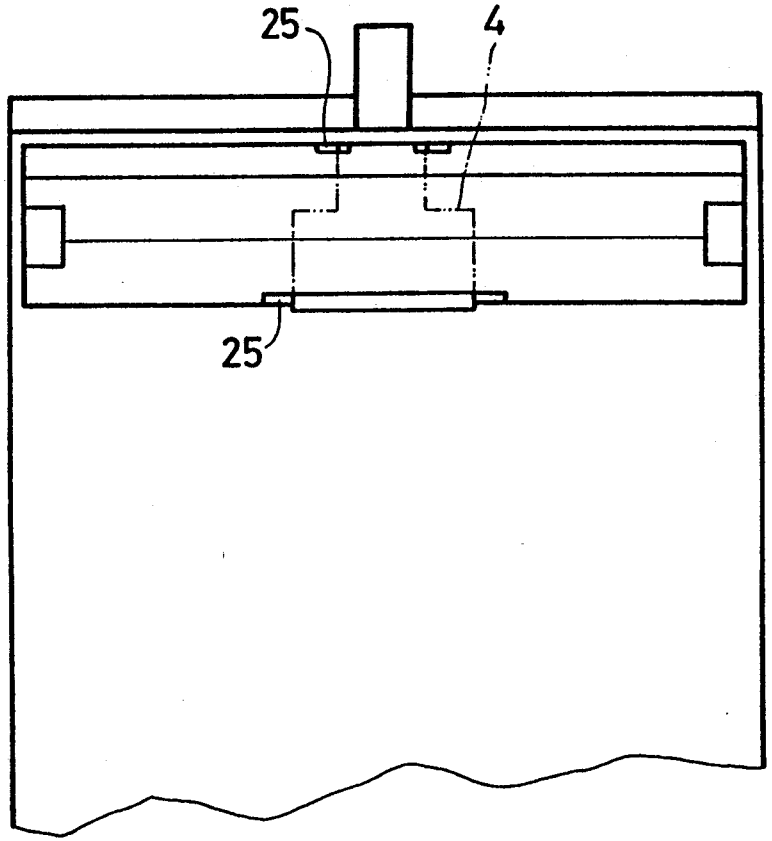
FIG. 5 is a partial bottom view of the receptacle with its cover plate removed.

A further advantage of the present invention lies in a specially designed rod clamping-and-releasing device 4. Referring now to FIG. 4, the clamping and releasing device 4 includes a body 16, comprising two elongated holes 20 for receiving a pin therein, with each end pulled down by two extension springs 18. Right beneath said pin 17, there is a button 24 pivotally connected to said body 16 at two lobes 28 and its free end can rest on the shoulder 19 of said body 16. Furthermore, said body 16 possesses a compression spring 21 with one end fixed on said body 16 in order to eject metal rod 3 with its circular groove 26 clamped between said pin 17 and said button 24, when said button 24 is pressed. On the bottom of said receptacle 1, two injection-molded plates are integrally formed with said receptacle 1. Referring now to FIG. 5, the rod clamping-and-releasing device 4 is inserted into two slots 25 on the receptacle and covered by a plate 11. In this manner, said rod clamping-and-releasing device will be seated in place.

When a librarian pushes said button 24, said rod 3 will be ejected so that the librarian can freely deal with the catalogue cards.

It is to be understood that the receptacle, slidable back-up plate, the rod clamping-and-releasing device, and the other parts of the present invention may of course be embodied in a variety of modified or improved forms within the scope of the appended claims.

I claim:

1. A drawer for storing catalogue cards, which comprises:

(a) a receptacle in which a hole is provided;

(b) a back-up plate in which a hole is provided, said back-up plate being mounted on said receptacle;

(c) a rod clamping-and-releasing device in which two holes are provided, said rod clamping-and-releasing device being mounted on said receptacle;

(d) a rod passing through said receptacle, said back-up plate and said rod clamping-and-releasing device, said rod clamping-and-releasing device being further provided with two elongated holes, a pin and two extension springs, said pin being pulled down by said extension springs in order to clamp the rod, and said rod clamping-and-releasing device further comprising a button and a spring for releasing said rod.

2. A drawer for storing catalogue cards as recited in claim 1, further comprising a toothed rack mounted on said receptacle, wherein said back-up plate is flexible for supporting a stack of catalogue cards, and said back-up plate is movable on said toothed rack and stops at any position on said toothed rack.

* * * * *